US007410393B1

(12) United States Patent
Rothermel et al.

(10) Patent No.: US 7,410,393 B1
(45) Date of Patent: Aug. 12, 2008

(54) ELECTRICAL CONNECTOR WITH PROGRAMMABLE LEAD FRAME

(75) Inventors: Brent Ryan Rothermel, Harrisburg, PA (US); Robert Neil Whiteman, Jr., Middletown, PA (US); Wayne Samuel Davis, Harrisburg, PA (US); Dennis Leroy Kemmick, Columbia, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/800,877

(22) Filed: May 8, 2007

(51) Int. Cl.
*H01R 4/09* (2006.01)

(52) U.S. Cl. ..... 439/608; 439/507; 439/49

(58) Field of Classification Search ..... 439/608, 439/507, 49, 510–512, 701
See application file for complete search history.

(56) References Cited

U.S. PATENT DOCUMENTS 4,089,041 A * 5/1978 Lockard ..... 361/767
4,290,661 A 9/1981 Burns
4,456,317 A * 6/1984 McCleerey ..... 439/101
4,488,768 A 12/1984 Sigmon
5,496,183 A 3/1996 Soes et al.
5,664,968 A 9/1997 Mickievicz
6,843,687 B2 * 1/2005 McGowan et al. ..... 439/608
6,955,565 B2 10/2005 Lloyd et al.
7,131,870 B2 11/2006 Whiteman, Jr. et al.
7,172,461 B2 2/2007 Davis et al.
2002/0111068 A1 * 8/2002 Cohen et al. ..... 439/608
2004/0171305 A1 * 9/2004 McGowan et al. ..... 439/608

FOREIGN PATENT DOCUMENTS

EP 1 107 387 A1 6/2001
WO WO 2006/029670 A1 3/2006

* cited by examiner

*Primary Examiner*—Gary F. Paumen

(57) ABSTRACT

A contact module assembly is provided for an electrical connector. The contact module assembly includes a lead frame having a plurality of terminals and a commoning member at least partially including an electrically conductive material. The commoning member has a plurality of tabs that are electrically connected to selected ones of the terminals, thereby electrically commoning the selected ones of the terminals. The commoning member can be configured with different patterns of the tabs to selectively configure the lead frame with different patterns of commoned terminals.

20 Claims, 17 Drawing Sheets

ELECTRICAL CONNECTOR WITH PROGRAMMABLE LEAD FRAME

BACKGROUND OF THE INVENTION

This invention relates generally to electrical connectors, and more particularly to an electrical connector using a lead frame structure that is programmable into a plurality of different wiring patterns.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput.

In a traditional approach for interconnecting circuit boards, one circuit board serves as a back plane and the other as a daughter board. The back plane typically has a connector, commonly referred to as a header, which includes a plurality of signal contacts which connect to conductive traces on the back plane. The daughter board connector, commonly referred to as a receptacle, also includes a plurality of contacts. Typically, the receptacle is a right angle connector that interconnects the back plane with the daughter board so that signals can be routed therebetween. The right angle connector typically includes a mating face that receives the plurality of signal pins from the header on the back plane, and contacts on a mounting face that connect to the daughter board.

At least some right angle connectors include a plurality of contact modules that are received in a housing. The contact modules typically include a lead frame encased in a dielectric body. The lead frame includes a plurality of terminals that interconnect electrical contacts held on a mating edge of the contact module with corresponding contacts held on a mounting edge of the contact module. Different contact modules of the same connector sometimes have different patterns, sometimes referred to as wiring patterns, of the terminals and/or the mating and mounting edge contacts. For example, adjacent contact modules within the housing may have different patterns of signal, power, and/or ground terminals and/or contacts to enhance the electrical performance of the connector by reducing crosstalk between the adjacent contact modules. However, different lead frames must be designed and manufactured for each of the contact modules having different terminal and/or contact patterns, which may increase a difficulty and/or cost of manufacturing the connector.

There is a need for a lower cost electrical connector that is more easily manufactured.

BRIEF DESCRIPTION OF THE INVENTION

In one embodiment, a contact module assembly is provided for an electrical connector. The contact module assembly includes a lead frame having a plurality of terminals and a commoning member at least partially including an electrically conductive material. The commoning member has a plurality of tabs that are electrically connected to selected ones of the terminals, thereby electrically commoning the selected ones of the terminals. The commoning member can be configured with different patterns of the tabs to selectively configure the lead frame with different patterns of commoned terminals.

In another embodiment, an electrical connector is provided. The electrical connector includes a housing and first and second contact module assemblies held by the housing. Each of the contact module assemblies includes a lead frame having a plurality of terminals. The first contact module assembly includes a first commoning member at least partially including an electrically conductive material. The first commoning member has a plurality of first tabs that are electrically connected to selected ones of the terminals of the first contact module assembly, thereby electrically commoning the selected ones of the terminals of the first contact module assembly. The first tabs are arranged to configure the lead frame of the first contact module assembly with a first pattern of commoned terminals. The second contact module assembly includes a second commoning member at least partially including an electrically conductive material. The second commoning member has a plurality of second tabs that are electrically connected to selected ones of the terminals of the second contact module assembly, thereby electrically commoning the selected ones of the terminals of the second contact module assembly. The second tabs are arranged to configure the lead frame of the second contact module assembly with a second pattern of commoned terminals that is different from the first pattern.

DETAILED DESCRIPTION OF THE INVENTION

Figure 1:
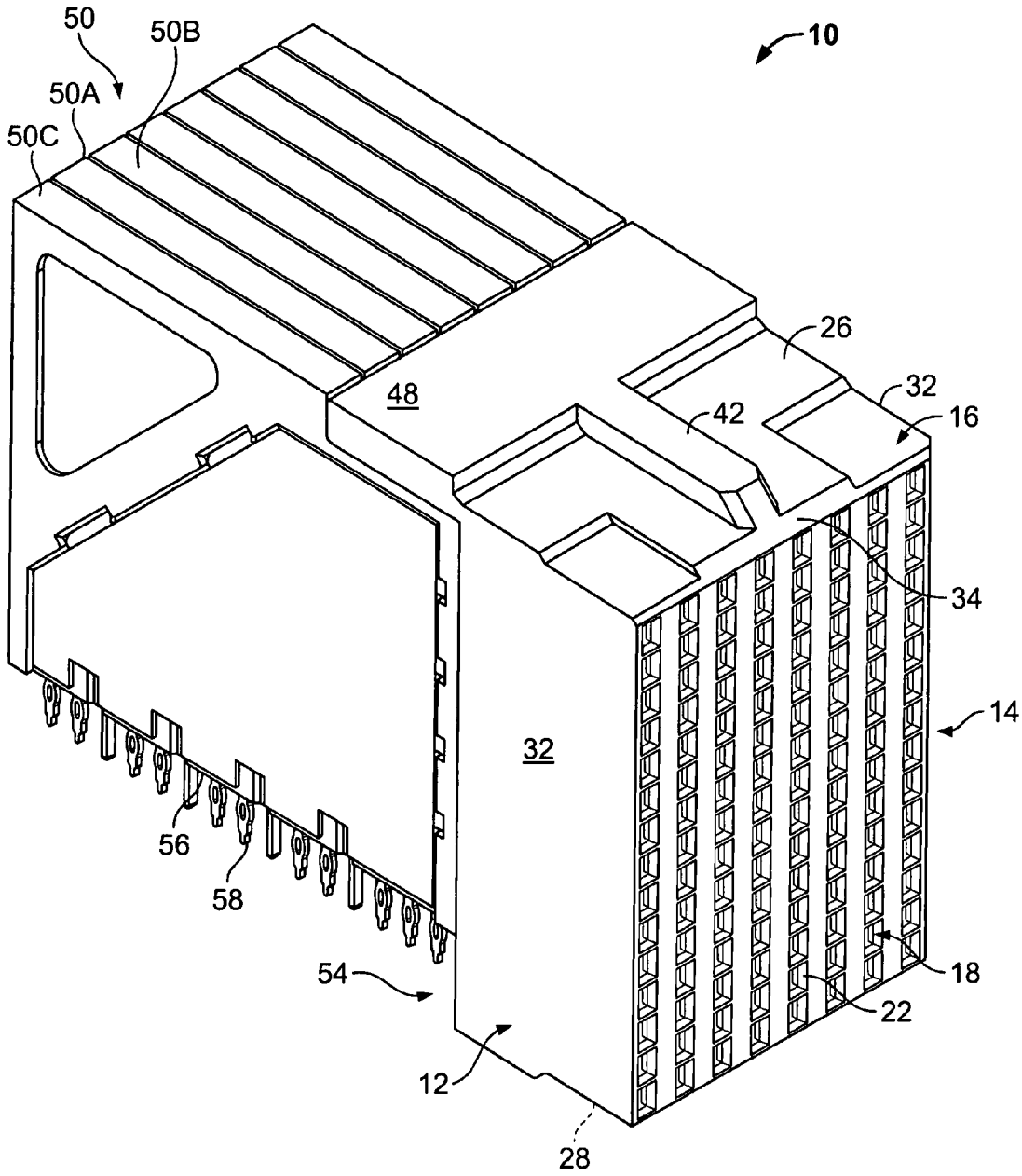
FIG. 1 is a perspective view of an exemplary embodiment of an electrical connector.

FIG. 1 illustrates an exemplary embodiment of an electrical connector 10. While the connector 10 will be described with particular reference to a receptacle connector, it is to be understood that the benefits herein described are also applicable to other connectors in alternative embodiments. The following description is therefore provided for purposes of illustration, rather than limitation, and is but one potential application of the inventive concepts herein.

The connector 10 includes a dielectric housing 12 having a forward mating end 14 that includes a shroud 16 and a mating face 18. The mating face 18 includes a plurality of mating contacts 20 (shown in FIGS. 3 and 4), such as, for example, contacts within contact cavities 22, that are configured to receive corresponding mating contacts (not shown) from a mating connector (not shown). The shroud 16 includes an upper surface 26 and a lower surface 28 between opposed sides 32. The upper and lower surfaces 26 and 28, respectively, each include a chamfered forward edge portion 34. An alignment rib 42 is formed on the upper shroud surface 26 and lower shroud surface 28. The chamfered edge portion 34 and the alignment ribs 42 cooperate to bring the connector 10 into alignment with the mating connector during the mating process so that the contacts in the mating connector are received in the contact cavities 22 without damage.

The housing 12 also includes a rearwardly extending hood 48. A plurality of contact module assemblies 50 are received in the housing 12 from a rearward end 54. The contact module assemblies 50 define a connector mounting face 56. The connector mounting face 56 includes a plurality of contacts 58, such as, but not limited to, pin contacts, or more particularly, eye-of-the-needle-type contacts, that are configured to be mounted to a substrate (not shown), such as, but not limited to, a circuit board. In an exemplary embodiment, the mounting face 56 is substantially perpendicular to the mating face 18 such that the connector 10 interconnects electrical components that are substantially at a right angle to one another. In one embodiment, the housing 12 holds two or more different types of contact module assemblies 50, such as, but not limited to, contact module assemblies 50A, 50B, 50C (shown in FIGS. 10 and 11, 13 and 14, and 18, respectively), a contact module assembly (not shown) formed using the commoning member 424 (FIG. 15), and/or a contact module assembly (not shown) formed using the commoning member 624 (FIG. 16). Alternatively, the housing 12 may hold only a single type of contact module assemblies 50, such as, but not limited to, any of the contact module assemblies 50A, 50B, 50C, the contact module assembly formed using the commoning member 424, or the contact module assembly formed using the commoning member 624.

Figure 2:
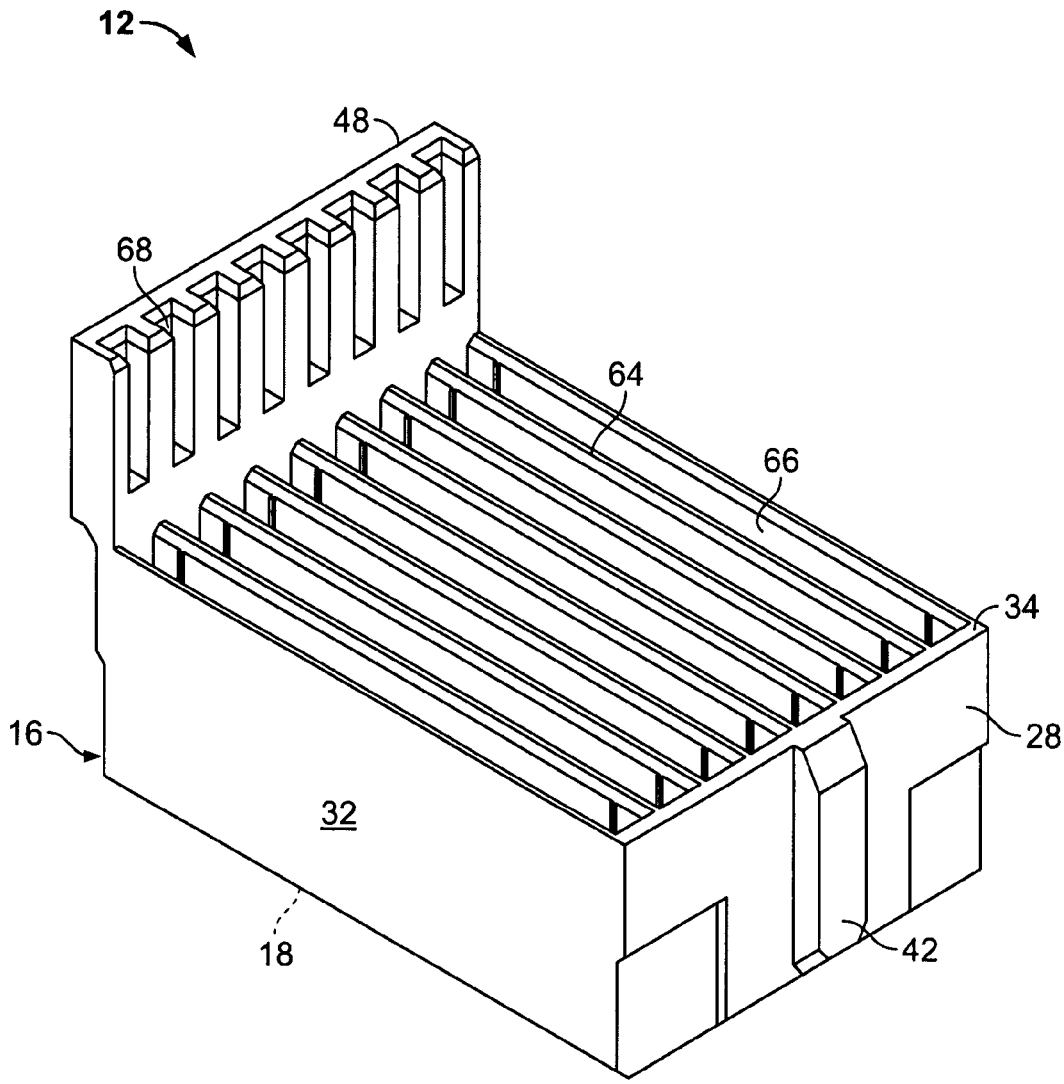
FIG. 2 is a rear perspective view of an exemplary housing of the electrical connector shown in FIG. 1.

FIG. 2 illustrates a rear perspective view of the housing 12. The housing 12 includes a plurality of dividing walls 64 that define a plurality of chambers 66. The chambers 66 receive a forward portion of the contact module assemblies 50 (FIG. 1). A plurality of slots 68 are formed in the hood 48. The chambers 66 and slots 68 cooperate to stabilize the contact module assemblies 50 when the contact module assemblies 50 are loaded into the housing 12. In the exemplary embodiment, the chambers 66 each have about an equal width and the slots 68 each have about an equal width. However, some or all of the chambers 66, and/or some or all of the slots 68, may different widths for accommodating differently sized contact module assemblies 50. The chambers 66 and slots 68 may optionally extend substantially an entire length of the contact module assemblies 50 such that the chamber walls separate adjacent contact module assemblies 50.

Figure 3:
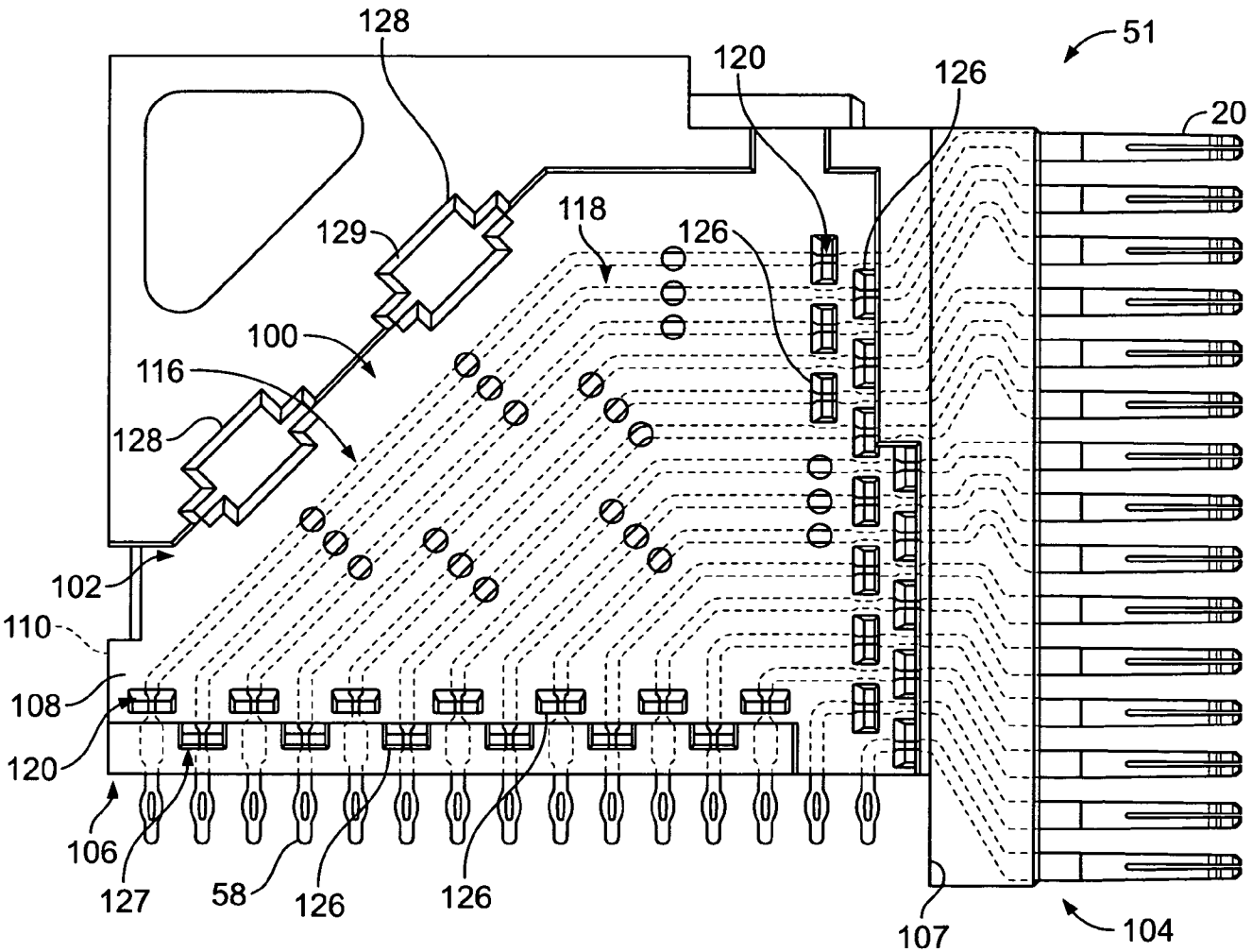
FIG. 3 is a side view of an exemplary embodiment of a contact module that may be used with the electrical connector shown in FIG. 1.
Figure 4:
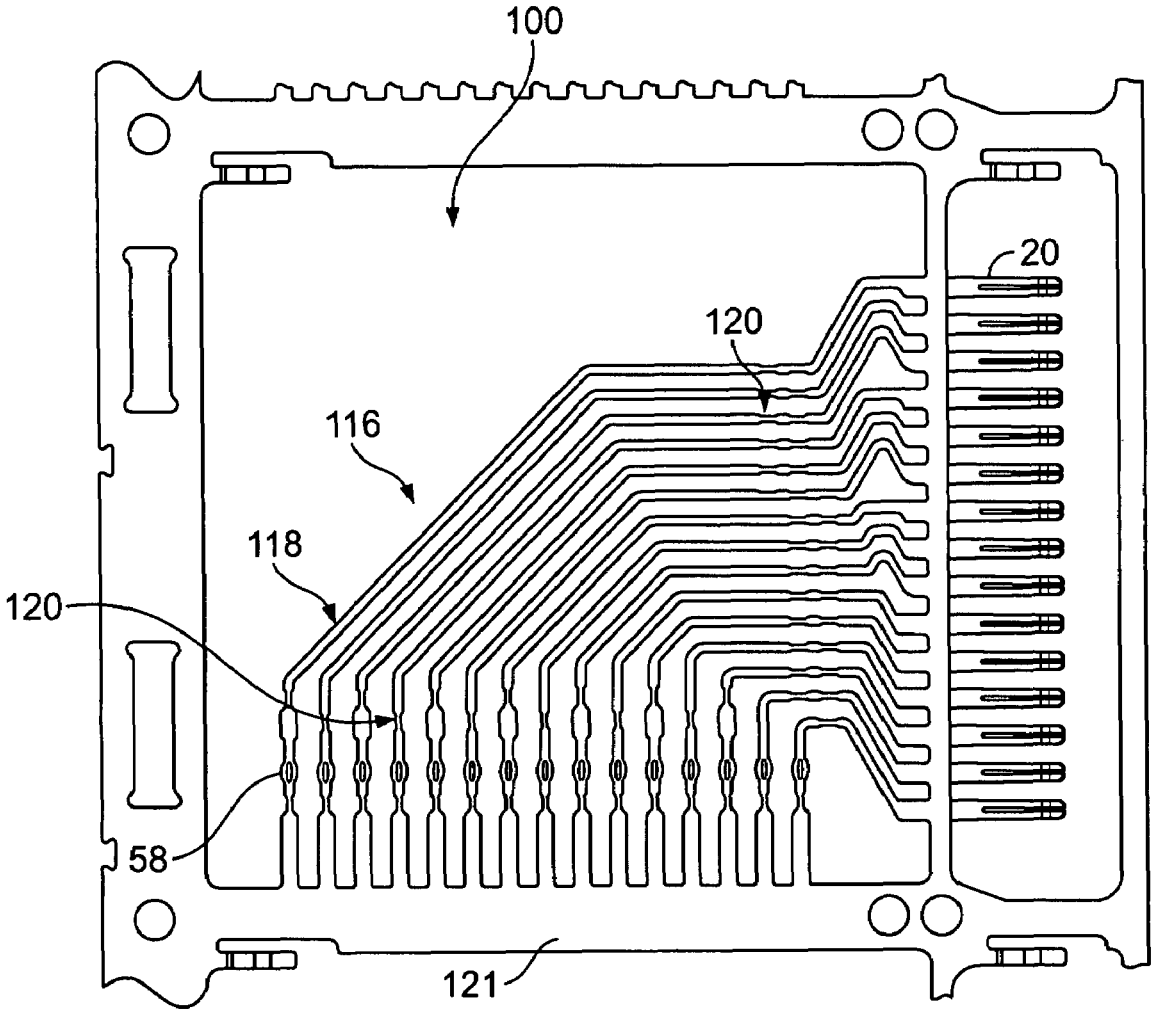
FIG. 4 is a side view of an exemplary embodiment of a lead frame for the contact module shown in FIG. 3.

FIG. 3 illustrates an exemplary embodiment of a contact module 51 that includes an exemplary embodiment of an internal lead frame 100, shown in phantom outline, and a dielectric body 102. FIG. 4 illustrates the lead frame 100 that is held within the contact module 51. The lead frame 100 includes a plurality of terminals 116 enclosed within the body 102. The mating contacts 20 extend from a mating edge portion 104 of the body 102 and the lead frame 100, and the mounting contacts 58 extend from a mounting edge portion 106 of the body 102 and the lead frame 100. The mounting edge portion 106 intersects with a rearward facing end wall 107 proximate the mating edge portion 104. Alternatively, the mating edge portion 104 may intersect the mounting edge 106. The body 102 includes opposite side portions 108 and 110 that extend substantially parallel to and along the lead frame 100. In some embodiments, the body 102 is manufactured using an over-molding process. During the molding process, the lead frame 100 is encased in a dielectric material, which forms the body 102. As illustrated in FIG. 4, prior to over-molding the lead frame 100 is preferably stabilized by an integral chip carrier strip 121 which is removed and discarded after the over-molding process that creates the body 102. In the exemplary embodiment, the mating and mounting edge portions 104 and 106, respectively, extend substantially perpendicular to each other. However, the mating and mounting edge portions 104 and 106, respectively, may extend any direction relative to each other, such as, but not limited to, substantially parallel.

The lead frame 100 includes the plurality of terminals 116 that extend along predetermined paths to electrically connect each mating contact 20 to a corresponding mounting contact 58. The terminals 116 include the mating and mounting contacts 20 and 58, respectively, and an intermediate terminal portion 118, which extends between the mating and mounting contacts 20 and 58, respectively. In some embodiments, the intermediate terminal portion 118 extends obliquely between the mating and mounting contacts 20 and 58, respectively. For example, in the exemplary embodiment, the intermediate terminal portion 118 extends at approximately a forty-five degree angle between the mating and mounting contacts 20 and 58, respectively. The terminals 116 may be either signal terminals, ground terminals, or power terminals. The lead frame 100 may include any number of terminals 116, any number of which may be selected as signal terminals, ground terminals, or power terminals according the desired wiring pattern programmed as described below. Optionally, adjacent signal terminals may function as differential pairs, and each differential pair may be separated by a ground terminal.

Figure 5:
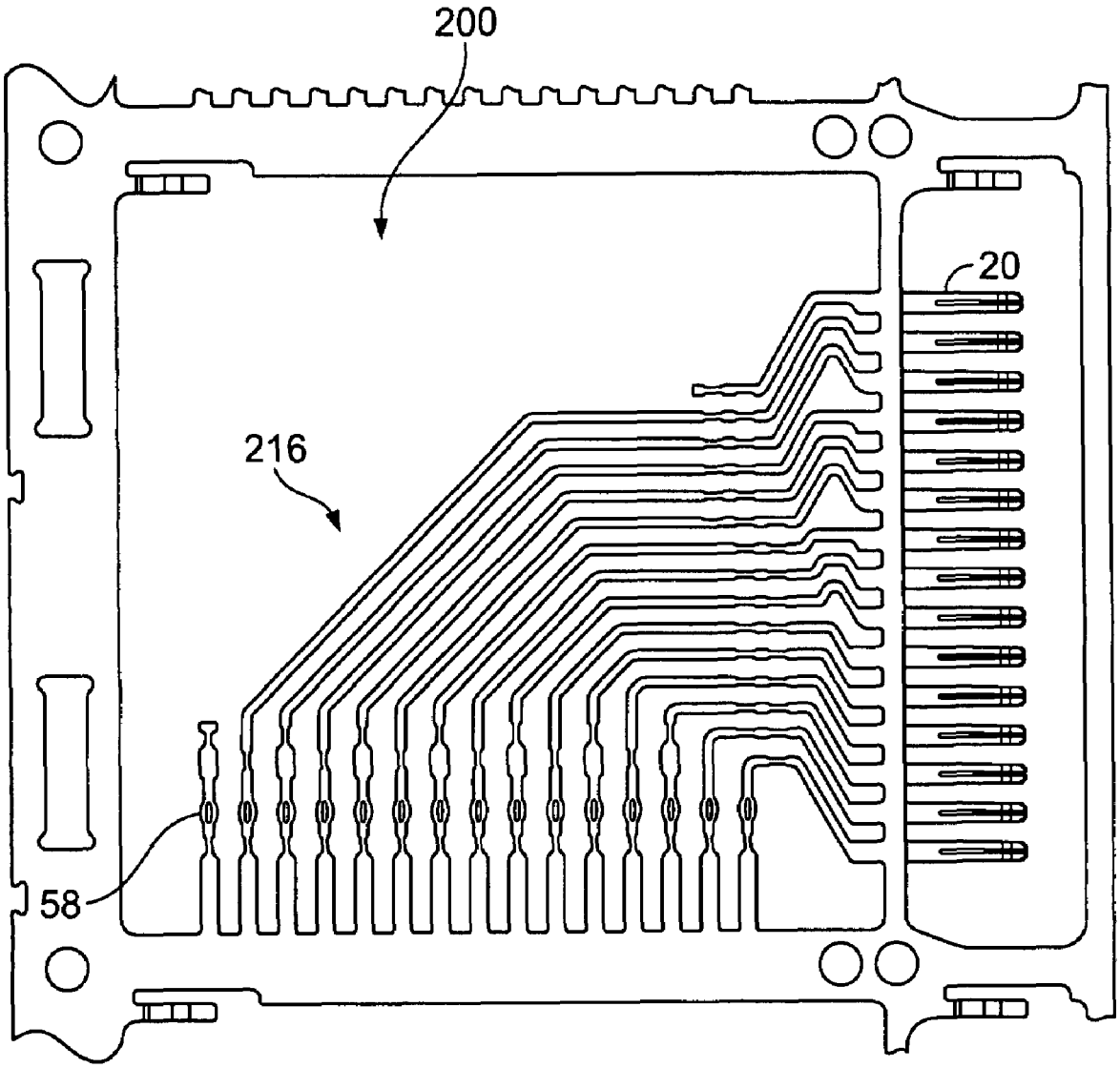
FIG. 5 is a side view of an exemplary alternative embodiment of a lead frame that may be used with the electrical connector shown in FIG. 1.

In alternative embodiments, at least a portion of the intermediate terminal portion 118 of one or more of any ground terminals may be removed such that the intermediate terminal portion 118 of such a ground terminal(s) does not connect the mating and mounting contacts 20 and 58, respectively, of the ground terminal(s). FIG. 5 illustrates an alternative embodiment of a lead frame 200 wherein the intermediate terminal portion of one of the terminals 216 has been removed such that the mating and mounting contacts 20 and 58, respectively, of the terminal 216 are not connected.

Figure 6:
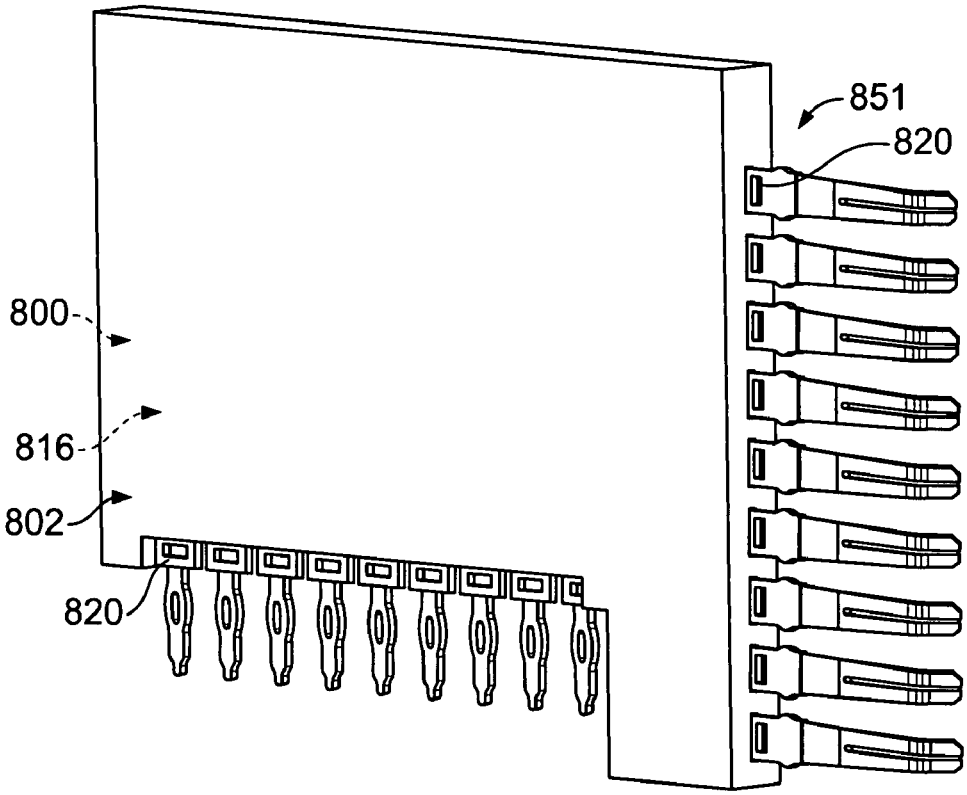
FIG. 6 is a perspective view of an exemplary alternative embodiment of a contact module that may be used with the electrical connector shown in FIG. 1.
Figure 7:
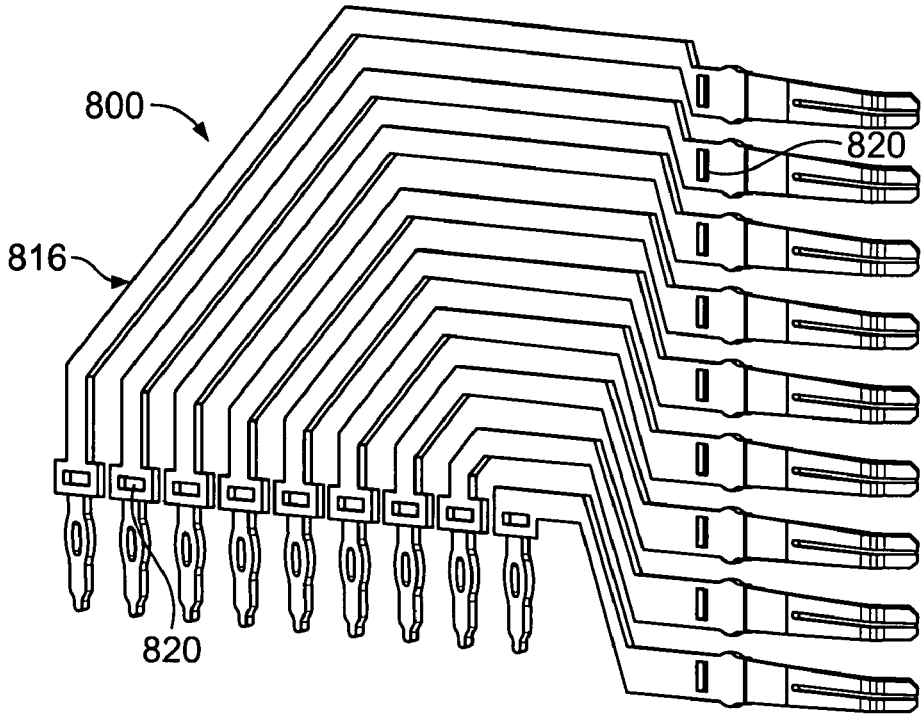
FIG. 7 is a perspective view of an exemplary alternative embodiment of a lead frame for the contact module shown in FIG. 6.

In the exemplary embodiment of FIGS. 3 and 4, each of the terminals 116 includes a necked-down portion 120 that is engaged by a corresponding electrically conductive tab 122, 322, 422, or 622 (FIGS. 8, 12, 15, and 16, respectively) of a respective commoning member 124, 324, 424, or 624 (FIGS. 8, 10, and 11, 12-14, 15, and 16, respectively), as will be described in more detail below. However, the terminals 116 may each have any suitable configuration, arrangement, and/or the like, and/or may include any suitable structure and/or means, that enable the terminals 116 to directly physically engage and electrically connect to the corresponding tab 122, 322, 422, or 622. For example, in an alternative embodiment shown in FIGS. 6 and 7, an exemplary alternative embodiment of a contact module 851 includes a lead frame 800 having a plurality of terminals 816. Each terminal 816 includes a pair of openings 820 therein for each receiving a tab 822 (FIG. 9) of a commoning member 824 (FIG. 9), as will be described in more detail below. As illustrated in FIG. 6, a dielectric body 802 that encloses a portion of the terminals 816 does not enclose the openings 820, such that the openings 820 are exposed. Alternatively, each of the openings 820 within the terminals 816 is exposed by a corresponding opening (not shown) within the dielectric body 802.

Referring again to FIG. 3, the dielectric body 102 includes a plurality of openings 126 that each exposes the necked-down portion 120 of a corresponding one of the terminals 116. The openings 126 may optionally include a chamfered edge portion 127 to facilitate reception of the corresponding tab 122, 322, 422, or 622 therein. The dielectric body 102 also includes a pair of openings 128 for receiving a corresponding retention member 130, 330, 430, or 630 (FIGS. 8, 12, 15, and 16, respectively) of the commoning member 124, 324, 424, or 624, respectively, to facilitate holding the commoning member 124, 324, 424, or 624 on the contact module 51, as will be described in more detail below. In some embodiments, in addition or alternative to the retention members 130, 330, 430, or 630, the engagement between the tabs 122, 322, 422, or 622 and the corresponding terminals 116 facilitate holding the commoning member 124, 324, 424, or 624 on the contact module 51. The openings 128 may have any suitable shape that enables the openings 128 to function as described and/or illustrated herein. Although two openings 128 are shown, the dielectric body 102 may include any number of openings 128. Optionally, the openings 128 may include a chamfered edge portion 129 to facilitate reception of the corresponding retention member 130, 330, 430, or 630 therein.

The contact module and lead frame embodiments described and/or illustrated herein provide contact modules having a lead frame structure that is selectively programmable with a plurality of different wiring patterns. Specifically, and with reference to the exemplary embodiment of FIGS. 3 and 4, each of the lead frame terminals 116 is selectively configurable as a signal terminal, a ground terminal, or a power terminal. The lead frame 100 is selectively configurable into different patterns of signal, ground, and/or power terminals using different commoning members (e.g., the commoning members 124, 324, 424, and 624, shown in FIGS. 8, 10, and 11, 12-14, 15, and 16 respectively). Specifically, tabs of the commoning members engage and electrically connect to selected terminals 116 of the lead frame 100 to electrically common the selected terminals 116. Different commoning members can be configured with different patterns of tabs to selectively configure the lead frame 100 with different patterns of commoned terminals.

Figure 8:
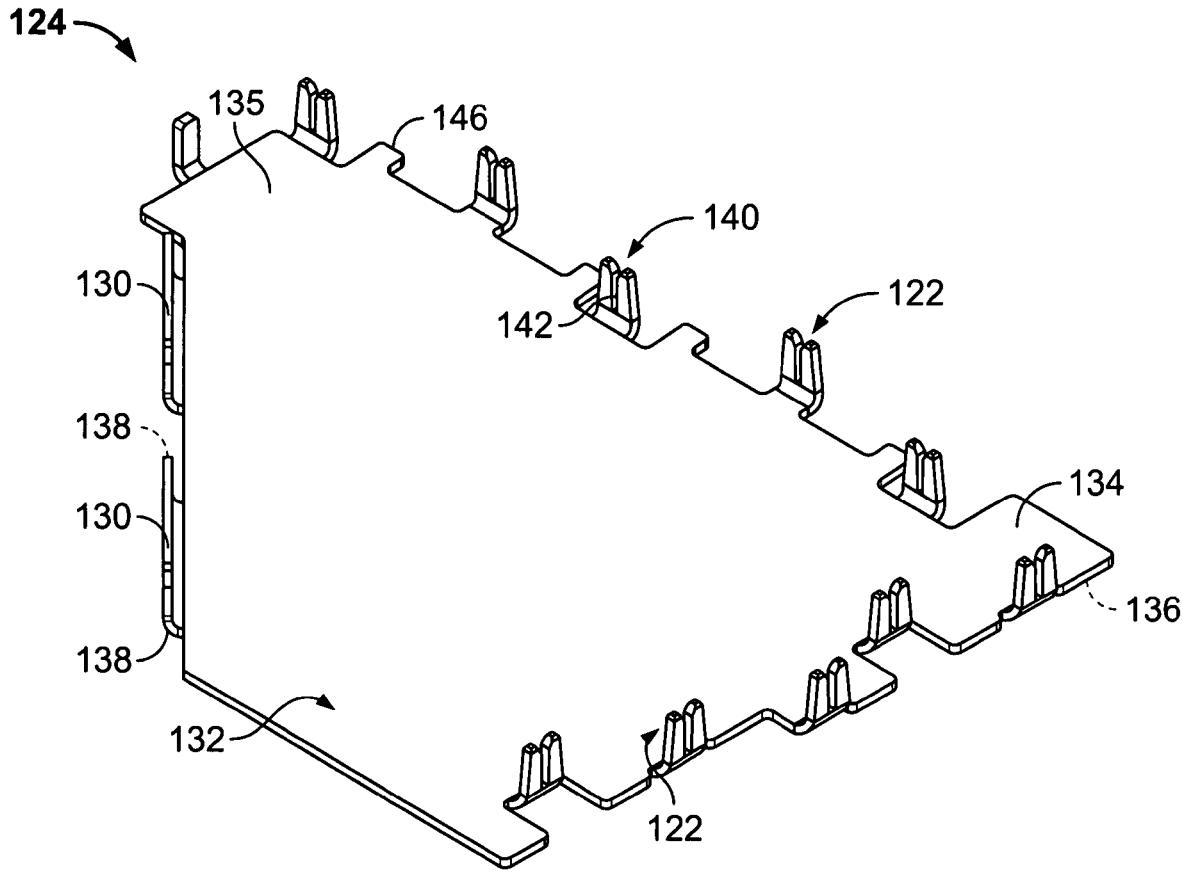
FIG. 8 is a perspective view of an exemplary embodiment of a commoning member that may be used with the contact module shown in FIG. 3.

FIG. 8 illustrates an exemplary embodiment of the commoning member 124. The commoning member 124 is fabricated at least partially from an electrically conductive material. The commoning member 124 includes a body 132 having opposite side portions 134 and 136 and a shield plate 135, which extends coplanar with the lead frame 100 when the commoning member 124 is mounted on the contact module 51. A pair of the retention members 130 extend outwardly on the side portion 134 for reception within the openings 128 (FIG. 3) within the dielectric body 102 (FIG. 3) to facilitate holding the commoning member 124 on the contact module 51 (FIG. 3). Although the retention members 130 may include any suitable structure, means, configuration, arrangement, and/or the like, in the exemplary embodiment the retention members 130 each include a pair of opposite hooks 138 that are configured to engage the dielectric body 102 adjacent the corresponding opening 128 to facilitate holding the commoning member 124 on the contact module 51. Although two retention members 130 are shown, the commoning member body 132 may include any number of retention members 130 for reception within any number of openings 128 within the dielectric body 102. Additionally or alternatively, the dielectric body 102 may include one or more retention members (not shown) extending outwardly therefrom for reception within one or more openings (not shown) within the commoning member body 132.

Figure 9:
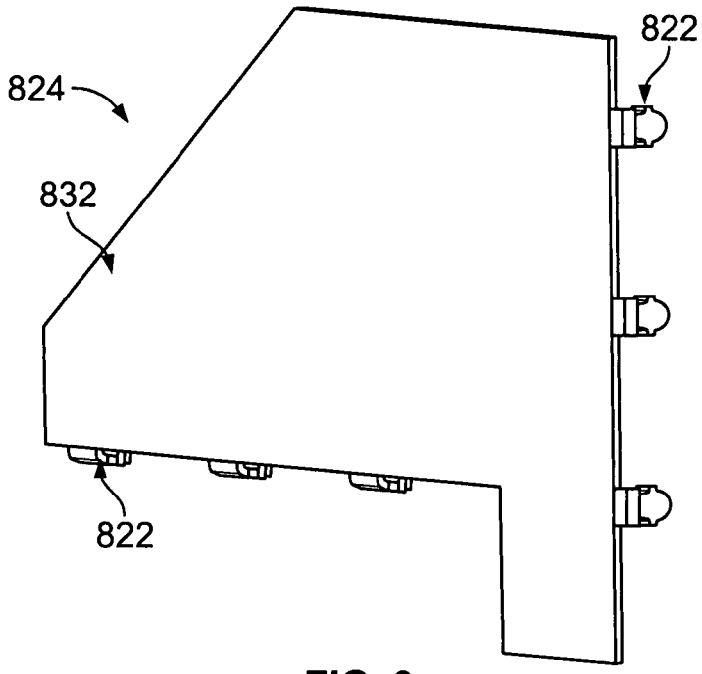
FIG. 9 is a perspective view of an exemplary alternative embodiment of a commoning member that may be used with the contact module shown in FIG. 6.

The commoning member body 132 also includes a plurality of the electrically conductive tabs 122 extending outwardly on the side portion 134. In the exemplary embodiment of FIG. 8, the tabs 122 are each insulation displacement contacts (IDCs) that include a forked portion 140 that defines an opening 142. When the commoning member 124 is mounted on the contact module 51 as described below, the necked-down portion 120 (FIGS. 3 and 4) of the corresponding terminal 116 (FIGS. 3 and 4) is received within the opening 142 and engages the forked portion 140 of each tab 122 to directly physically engage and electrically connect the tab 122 to the corresponding terminal 116. However, the tabs 122 may each be any suitable type of electrical contact, and may each have any suitable structure and/or means, that enable the tabs 122 to directly physically engage and electrically connect to the corresponding terminal 116, such as, but not limited to, IDC, pin, and/or eye of the needle contacts. For example, FIG. 9 illustrates an alternative embodiment of a commoning member 824. The commoning member 824 includes a body 832 that includes a plurality of the electrically conductive tabs 822 extending outwardly therefrom. The tabs 822 are pin contacts that, when the commoning member 824 is mounted on the contact module 851 (FIG. 6), each extend within a corresponding one of the openings 820 (FIG. 6) to directly physically engage and electrically connect each of the tabs 822 to the corresponding terminal 816.

Figure 10:
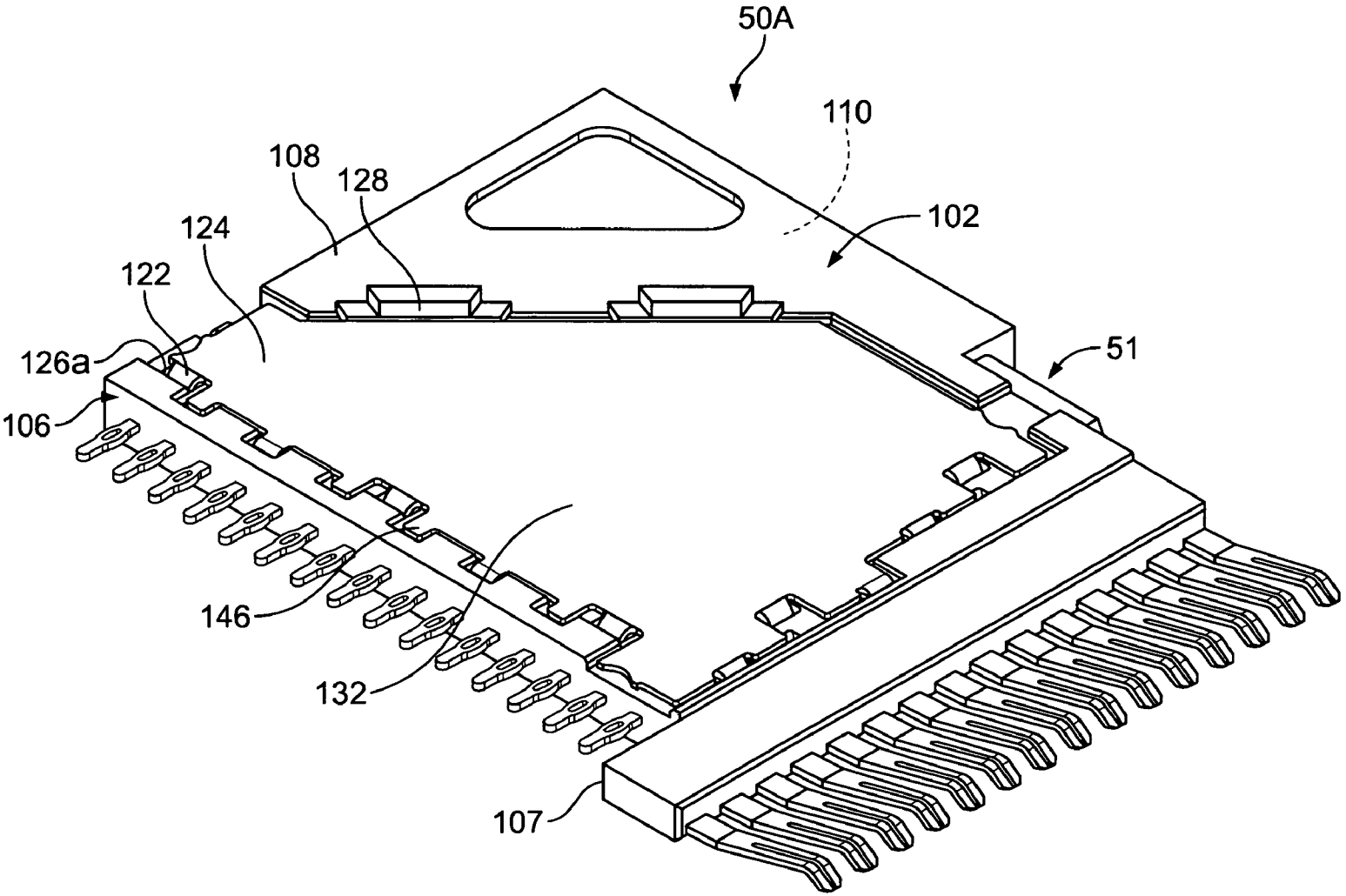
FIG. 10 is a perspective view of the commoning member shown in FIG. 8 mounted on the contact module shown in FIG. 3.
Figure 11:
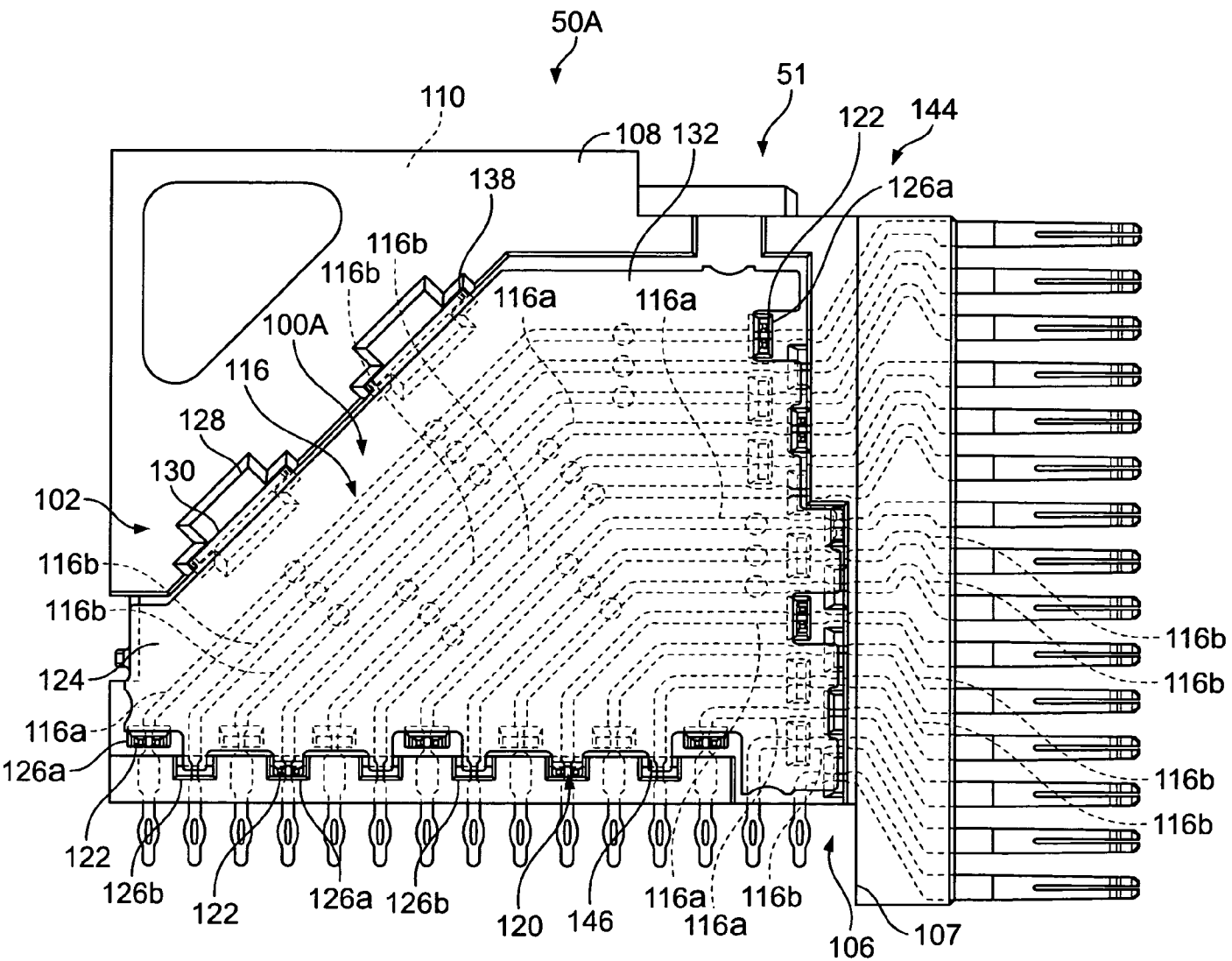
FIG. 11 is a top plan view of the contact module assembly shown in FIG. 10.

Referring again to FIG. 8, the commoning member 124 may have any number of the tabs 122, and the tabs 122 may have any suitable relative arrangement and/or pattern on the commoning member body 132, that configures the lead frame 100 (FIGS. 3 and 4) with the desired pattern of commoned terminals 116. FIGS. 10 and 11 illustrate the commoning member 124 mounted on the dielectric body 102 of the contact module 51 to provide a contact module assembly 50A having a lead frame 100A that is configured with an exemplary embodiment of a pattern 144 of electrically commoned terminals 116*a*. Specifically, the commoning member 124 is mounted on the side portion 108 of the dielectric body 102. Additionally or alternatively, a commoning member 124 is mounted on the side portion 110 of the dielectric body 102. Each of the retention members 130 is received within the corresponding opening 128 within the dielectric body 102 such that the hooks 138 are engaged with the dielectric body 102 to facilitate holding the commoning member body 132 on the dielectric body 102 of the contact module 51. In some embodiments, in addition or alternative to the retention members 130, the engagement between the tabs 122 and the corresponding terminals 116 facilitate holding the commoning member 124 on the dielectric body 102 of the contact module 51.

Each of the tabs 122 is received within a corresponding opening 126*a* of the dielectric body 102 and engages the necked down portion 120 of the corresponding terminal 116*a*. Because the commoning member body 132 is fabricated at least partially from an electrically conductive material, the commoning member 124 electrically commons each of the terminals 116*a*. The commoned terminals 116*a* may each be ground terminals or the commoned terminals 116*a* may each be power terminals. A plurality of openings 126*b* within the dielectric body 102 do not receive a tab 122, or any other portion, of the commoning member body 132 therein such that the corresponding terminals 116*b* are not electrically commoned. Each of the terminals 116*b* may be a signal terminal when the commoned terminals 116*a* are ground terminals or when the commoned terminals 116*a* are power terminals. Each of the terminals 116*b* may be a ground terminal when the commoned terminals 116*a* are power terminals, and each of the terminals 116*b* may be a power terminal when the commoned terminals 116*a* are ground terminals.

In the exemplary embodiment, the pattern 144 of the contact module assembly 50A includes a plurality of differential pairs of signal terminals 116*b* that are separated from each adjacent pair by a terminal 116*a*. The pattern 144 begins at the outermost terminal 116 (with respect to the intersection of the mounting edge portion 106 with the rearward facing end wall 107) with a terminal 116*a* and thereafter alternates differential pairs of signal terminals 116*b* with terminals 116*a* as the pattern 144 of terminals 116*a* and 116*b* moves toward the intersection of the mounting edge portion 106 with the end wall 107.

Optionally, the commoning member body 132 may include one or more extensions 146 positioned to at least partially cover a corresponding opening 126*b* to thereby at least partially block exposure of the corresponding terminal 116*b* through the opening 126*b*.

Figure 12:
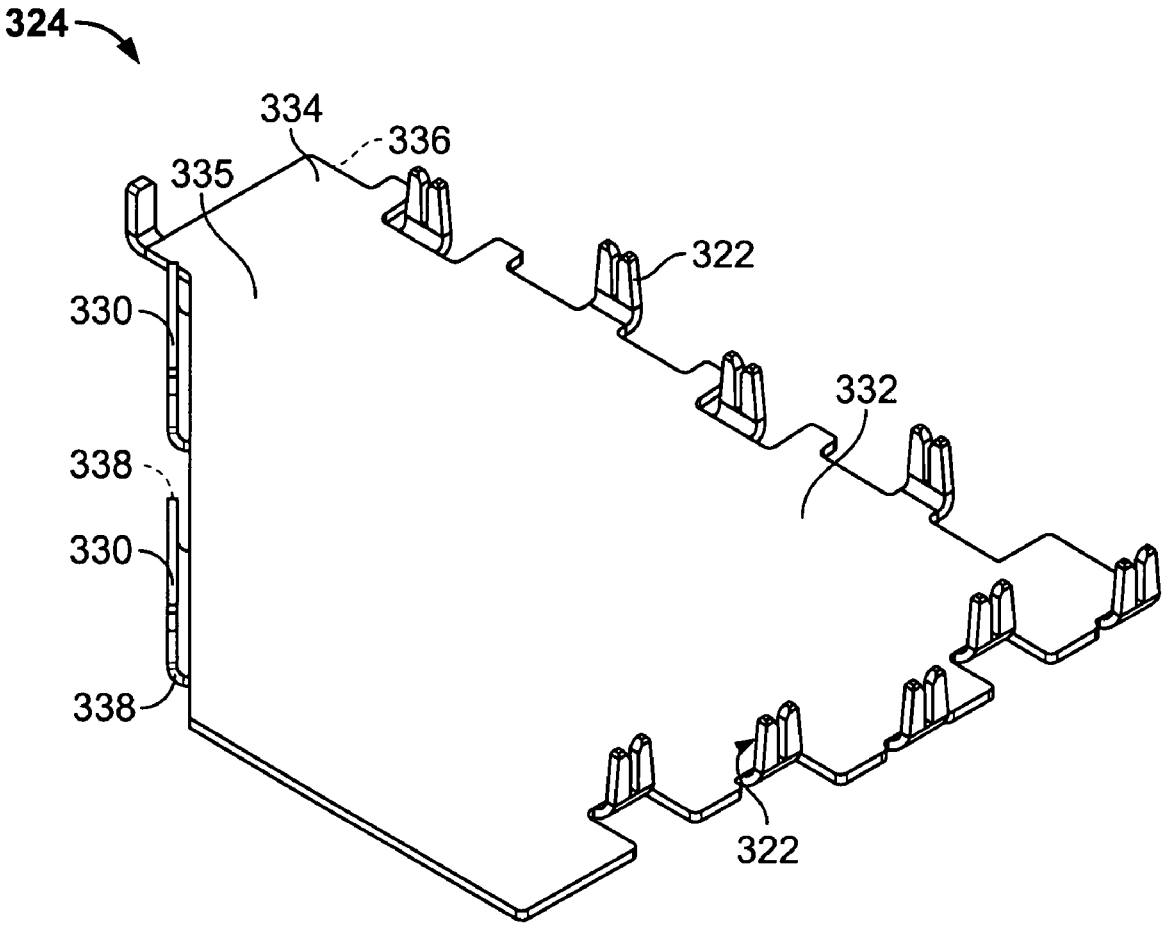
FIG. 12 is a perspective view of an exemplary embodiment of another commoning member that may be used with the contact module shown in FIG. 3.

FIG. 12 illustrates an exemplary embodiment of the commoning member 324. The commoning member 324 includes a body 332 having opposite side portions 334 and 336 and a shield plate 335, which extends coplanar with the lead frame 100 when the commoning member 324 is mounted on the contact module 51. A pair of the retention members 330 extend outwardly on the side portion 334 for reception within the openings 128 (FIG. 3) within the dielectric body 102 (FIG. 3). The retention members 330 each include a pair of opposite hooks 338 that are configured to engage the dielectric body 102 adjacent the corresponding opening 128 to facilitate holding the commoning member 324 on the contact module 51 (FIG. 3). The commoning member body 332 also includes a plurality of the electrically conductive tabs 322 extending outwardly on the side portion 334. The commoning member 324 may have any number of the tabs 322, and the tabs 322 may have any suitable relative arrangement and/or pattern on the commoning member body 332, that configures the lead frame 100 with the desired pattern of commoned terminals.

Figure 13:
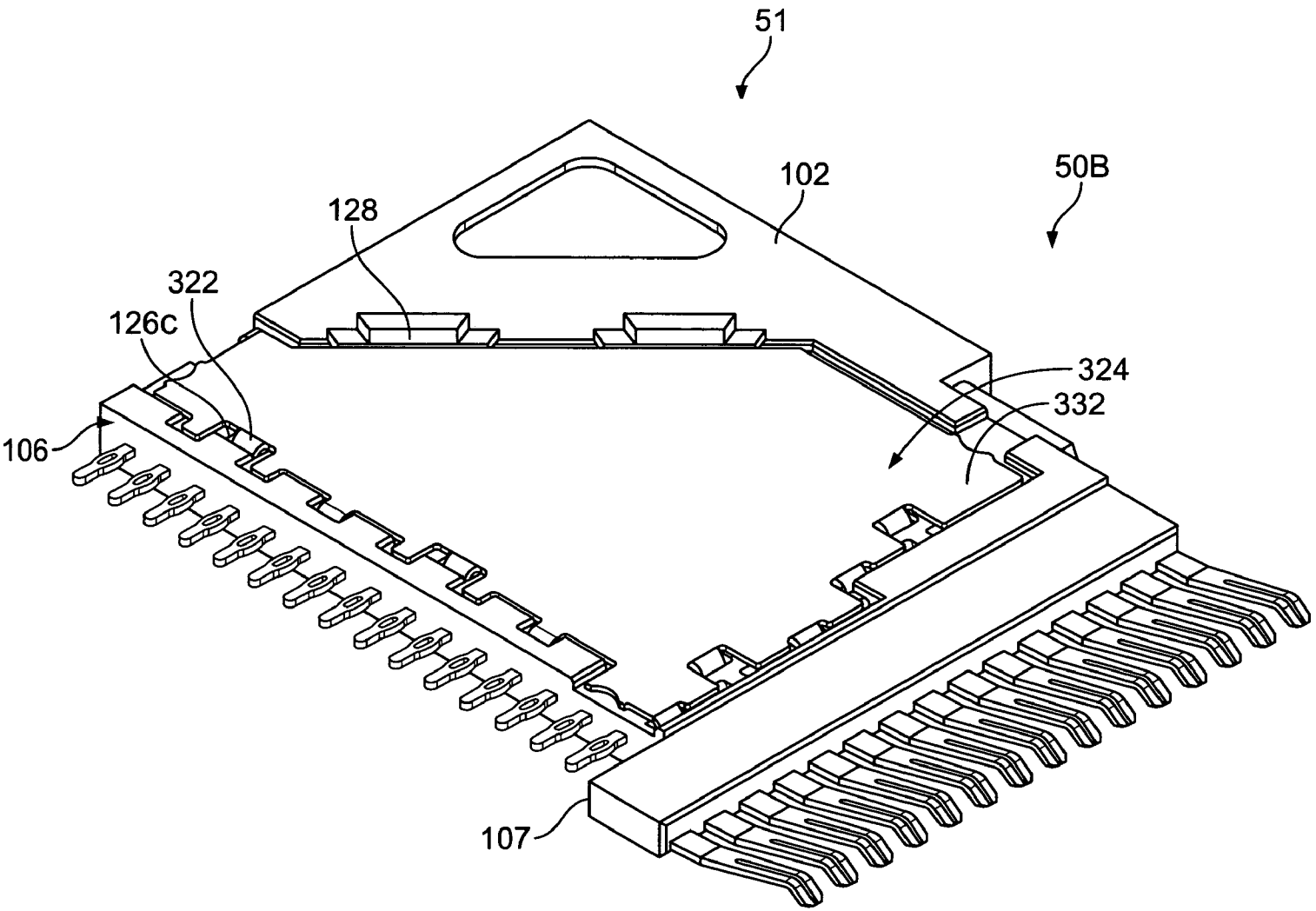
FIG. 13 is a perspective view of the commoning member shown in FIG. 12 mounted on the contact module shown in FIG. 3.
Figure 14:
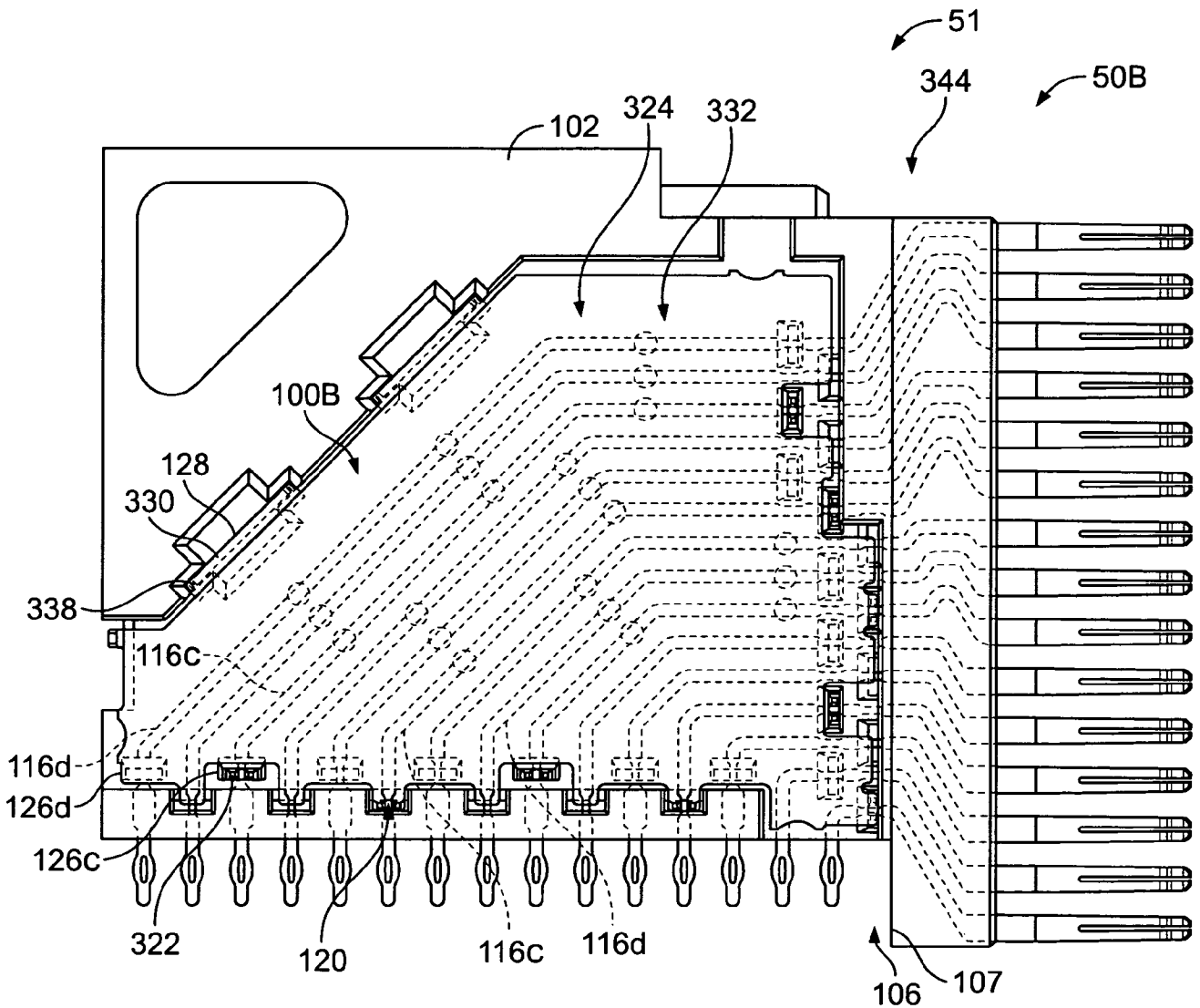
FIG. 14 is a top plan view of the contact module assembly shown in FIG. 13.

FIGS. 13 and 14 illustrate the commoning member 324 mounted on the dielectric body 102 of the contact module 51 to provide a contact module assembly 50B having a lead frame 100B that is configured with an exemplary embodiment of a pattern 344 of commoned terminals 116*c*. Each of the retention members 330 is received within the corresponding opening 128 within the dielectric body 102 such that the hooks 338 are engaged with the dielectric body 102 to facilitate holding the commoning member body 332 on the dielectric body 102 of the contact module 51.

Each of the tabs 322 is received within a corresponding opening 126*c* of the dielectric body 102 and engages the necked down portion 120 of the corresponding terminal 116*c*. Because the commoning member body 332 is fabricated at least partially from an electrically conductive material, the commoning member 324 electrically commons each of the terminals 116*c*. The commoned terminals 116*c* may each be ground terminals or the commoned terminals 116*c* may each be power terminals. A plurality of openings 126*d* within the dielectric body 102 do not receive a tab 322, or any other portion, of the commoning member body 332 therein such that the corresponding terminals 116*d* are not electrically commoned. Each of the terminals 116*d* may be a signal terminal when the commoned terminals 116*c* are ground terminals or when the commoned terminals 116*c* are power terminals. Each of the terminals 116*d* may be a ground terminal when the commoned terminals 116*c* are power terminals, and each of the terminals 116*d* may be a power terminal when the commoned terminals 116*c* are ground terminals.

In the exemplary embodiment, the pattern 344 of the contact module assembly 50B includes a plurality of differential pairs of signal terminals 116*d* that are each separated from each adjacent pair by a single terminal 116*c*. The pattern 344 begins at the innermost terminal 116 (with respect to the intersection of the mounting edge portion 106 with the rearward facing end wall 107) with a terminal 116*c* and thereafter alternates differential pairs of signal terminals 116*d* with terminals 116*c* as the pattern 344 of terminals 116*c* and 116*d* moves away from the intersection of the mounting edge portion 106 with the end wall 107.

Figure 15:
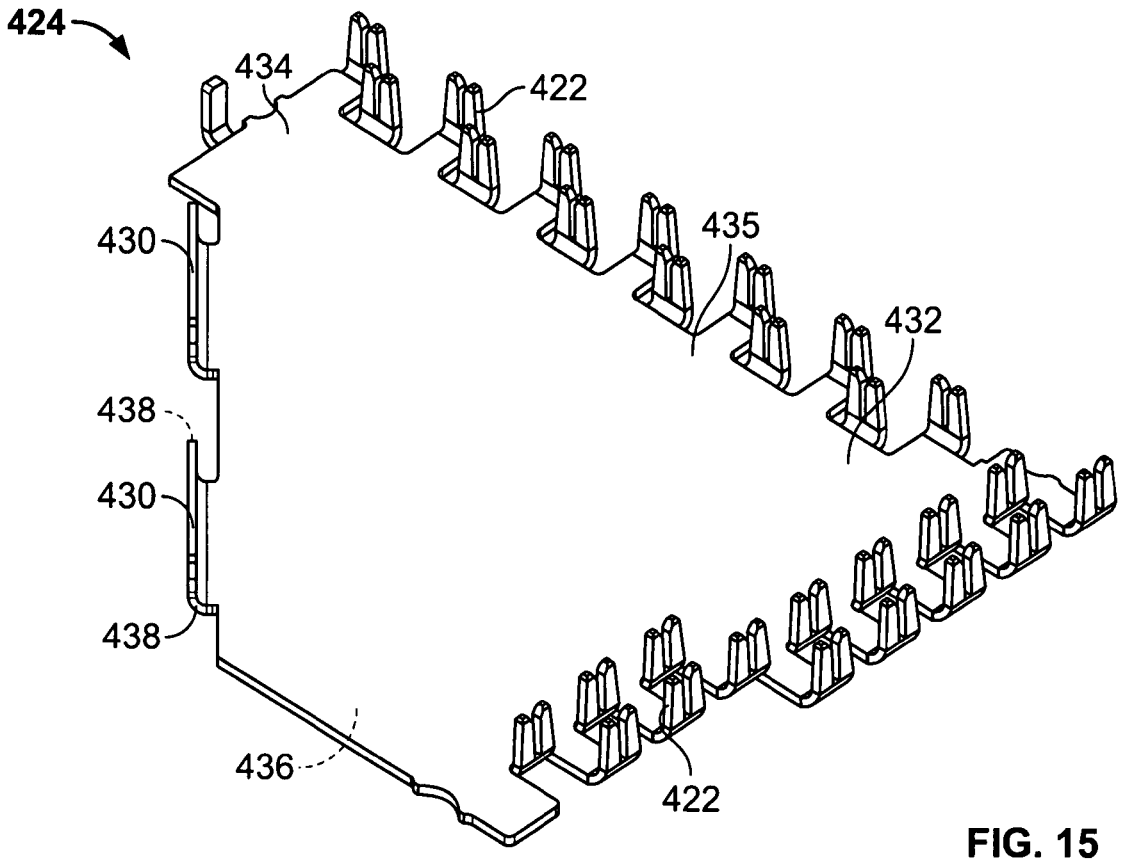
FIG. 15 is a perspective view of an exemplary embodiment of another commoning member that may be used with the contact module shown in FIG. 3.
Figure 16:
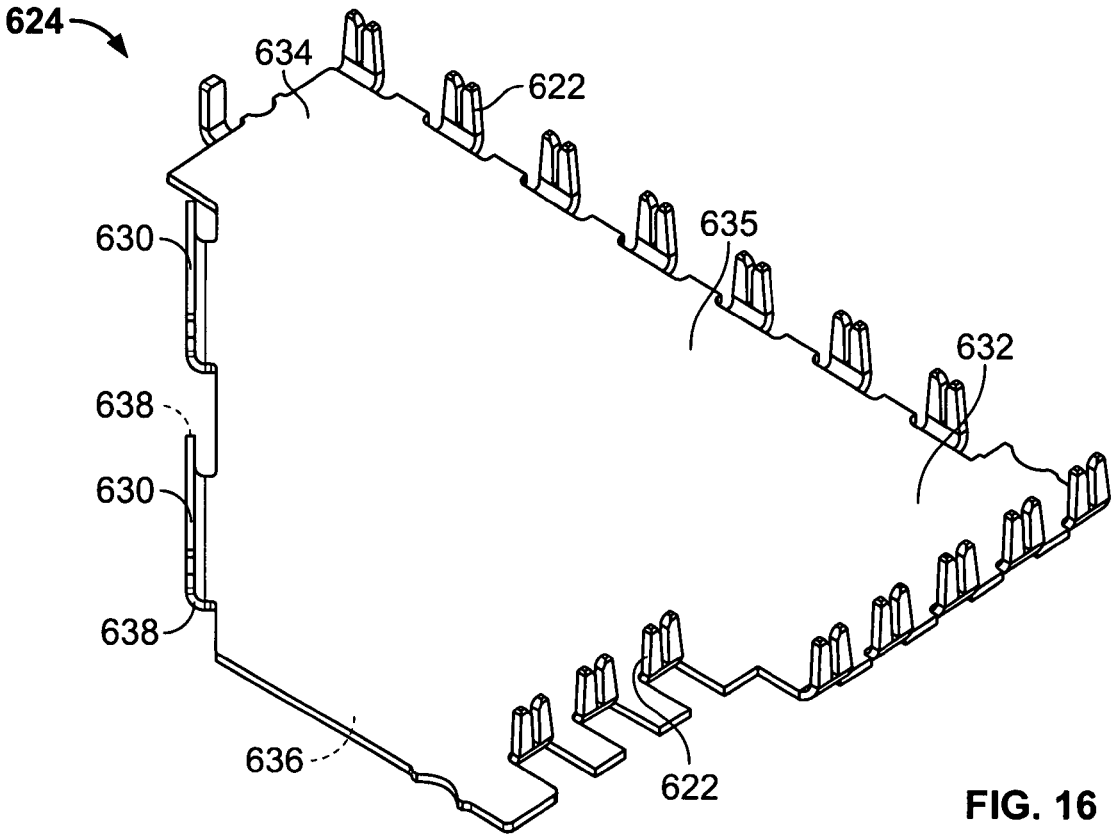
FIG. 16 is a perspective view of an exemplary embodiment of another commoning member that may be used with the contact module shown in FIG. 3.

FIG. 15 illustrates an exemplary embodiment of the commoning member 424. The commoning member 424 includes a body 432 having opposite side portions 434 and 436 and a shield plate 435, which extends coplanar with the lead frame 100 when the commoning member 424 is mounted on the contact module 51. Mounting of the commoning member 424 on the contact module 51 is not shown herein. A pair of the retention members 430 extend outwardly on the side portion 434 for reception within the openings 128 (FIG. 3) within the dielectric body 102 (FIG. 3). The retention members 430 each include a pair of opposite hooks 438 that are configured to engage the dielectric body 102 adjacent the corresponding opening 128 to facilitate holding the commoning member 424 on the contact module 51 (FIG. 3). The commoning member body 432 also includes a plurality of the electrically conductive tabs 422 extending outwardly on the side portion 434. The commoning member 424 may have any number of the tabs 422, and the tabs 422 may have any suitable relative arrangement and/or pattern on the commoning member body 432, that configures the lead frame 100 with the desired pattern of commoned.

In the exemplary embodiment of FIG. 15, each of the tabs 422 of the commoning member 424 is configured to engage and electrically connect to a corresponding terminal 116 to electrically common all of the terminals 116 of the lead frame 100 (FIGS. 3 and 4) of the contact module 51. Accordingly, when the commoning member 424 is mounted on the dielectric body 102 of the contact module 51, the commoning member 424 provides a lead frame (not shown) that is configured with a pattern (not shown) wherein all of the terminals 116 are electrically commoned. The terminals 116 that are all electrically commoned by the commoning member 424 may be configured as power terminals or ground terminals.

FIG. 16 illustrates an exemplary embodiment of the commoning member 624. The commoning member 624 includes a body 632 having opposite side portions 634 and 636 and a shield plate 635, which extends coplanar with the lead frame 100 when the commoning member 624 is mounted on the contact module 51. Mounting of the commoning member 624 on the contact module 51 is not shown herein. A pair of the retention members 630 extend outwardly on the side portion 634 for reception within the openings 128 (FIG. 3) within the dielectric body 102 (FIG. 3). The retention members 630 each include a pair of opposite hooks 638 that are configured to engage the dielectric body 102 adjacent the corresponding opening 128 to facilitate holding the commoning member 624 on the contact module 51 (FIG. 3). The commoning member body 632 also includes a plurality of the electrically conductive tabs 622 extending outwardly on the side portion 634. The commoning member 624 may have any number of the tabs 622, and the tabs 622 may have any suitable relative arrangement and/or pattern on the commoning member body 632, that configures the lead frame 100 with the desired pattern of commoned terminals.

As described above, the embodiments of the commoning members 124 and 324 (FIGS. 8, 10, and 11, and 12-14, respectively) may include signal terminals 116*b* and 116*d*, respectively, arranged in differential pairs. However, the commoning member 624 is intended for a single-ended application. Specifically, the tabs 622 of the commoning member 424 are configured to alternatively engage and electrically connect to the terminals 116 to provide a lead frame (not shown) that is configured with a pattern (not shown) wherein each terminal 116 that is not electrically connected to the commoning member 624 is separated from adjacent terminals 116 that are not electrically connected to the commoning member 624 by a single terminal 116 that is electrically connected to, and therefore commoned by, the commoning member. The commoned terminals 116 may each be ground terminals or the commoned terminals 116 may each be power terminals. Each of the terminals 116 that are not electrically connected to the commoning member 624 may be a signal terminal when the commoned terminals 116 are ground terminals or when the commoned terminals 116 are power terminals. Each of the terminals 116 that are not electrically connected to the commoning member 624 may be ground terminals when the commoned terminals 116 are power terminals, and each of the terminals 116 that are not electrically connected to the commoning member 624 may be power terminals when the commoned terminals 116 are ground terminals.

Figure 17:
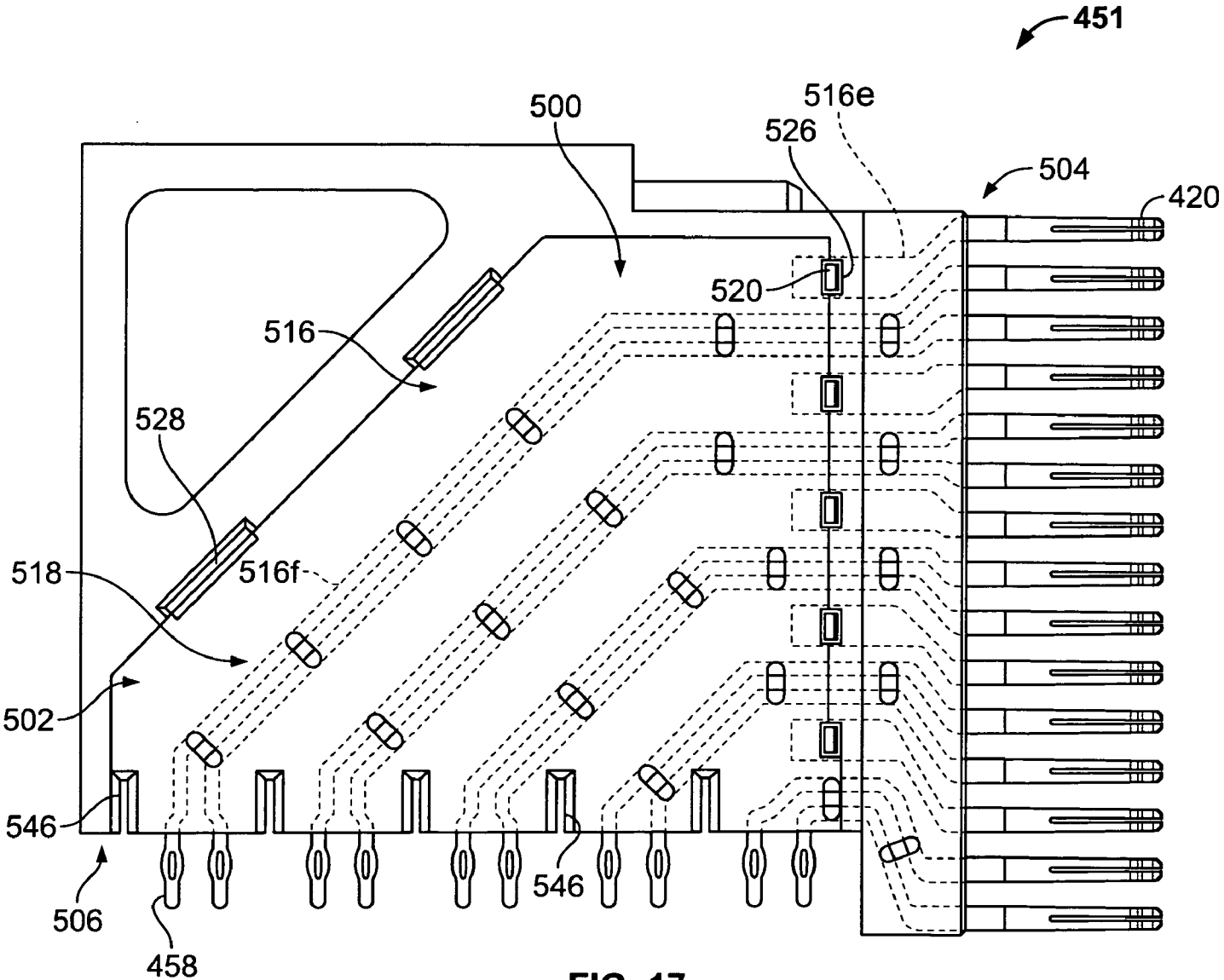
FIG. 17 is a side view of an exemplary alternative embodiment of a contact module that may be used with the electrical connector shown in FIG. 1.
Figure 18:
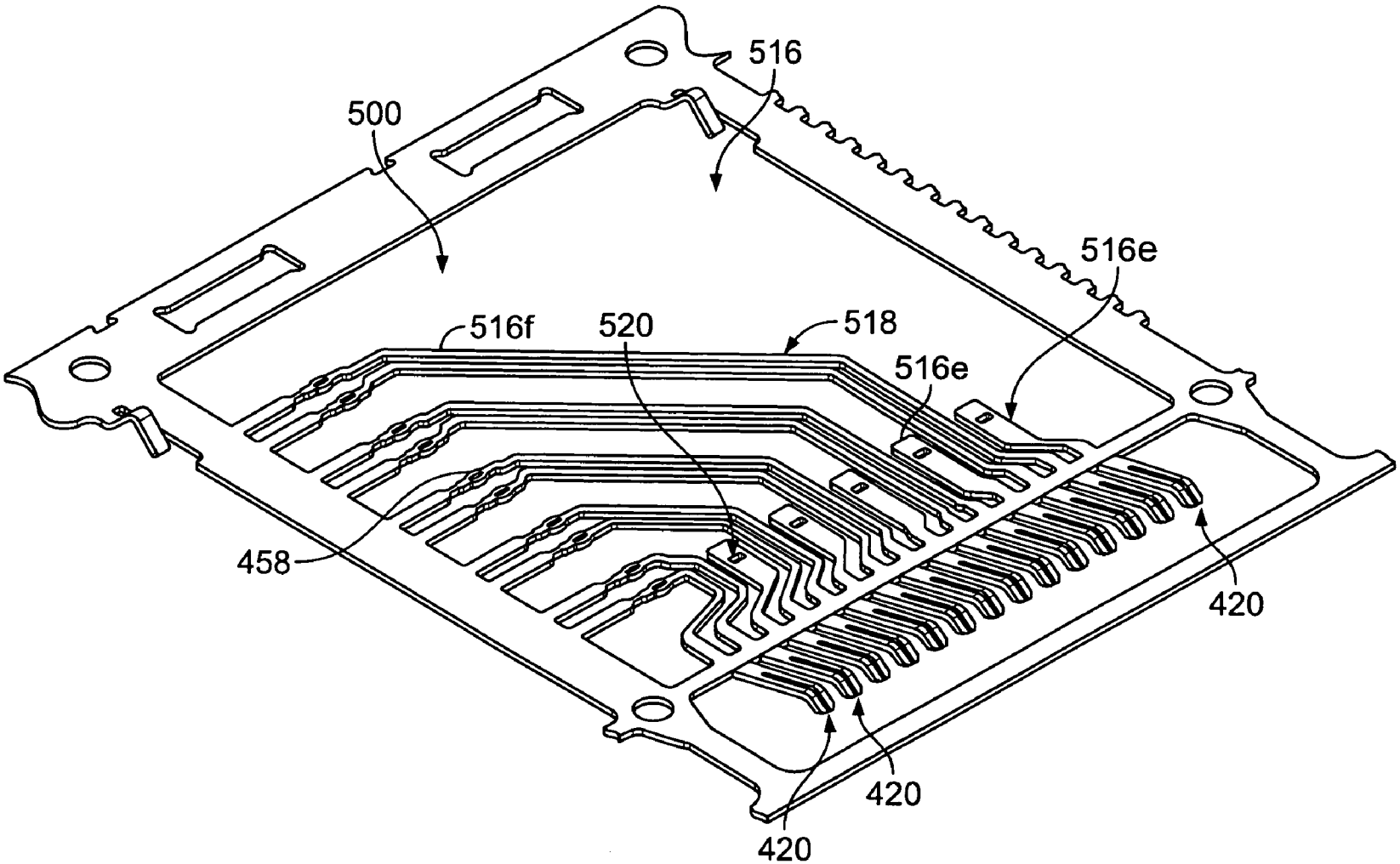
FIG. 18 is a perspective view of an exemplary alternative embodiment of a lead frame for the contact module shown in FIG. 17.

FIG. 17 illustrates an alternative embodiment of a contact module 451 that includes an alternative embodiment of an internal lead frame 500, shown in phantom outline, and a dielectric body 502. FIG. 18 illustrates the lead frame 500 that is held within the contact module 451. In the exemplary embodiment of FIGS. 17 and 18, the contact module 451 and lead frame 500 are not configured as programmable. However, in alternative embodiments, the contact module 451 and lead frame 500 may be configured as programmable. The lead frame 500 includes a plurality of terminals 516 enclosed within the body 502. Mating contacts 420 extend from a mating edge portion 504 of the body 502 and the lead frame 500, and mounting contacts 458 extend from a mounting edge portion 506 of the body 502 and the lead frame 500. A plurality of signal terminals 516*f* extend along predetermined paths to electrically connect the corresponding mating contact 420 to the corresponding mounting contact 458. The signal terminals 516*f* include the mating and mounting contacts 420 and 458, respectively, and an intermediate terminal portion 518, which extends between the mating and mounting contacts 420 and 458, respectively. A plurality of ground terminals 516*e* each include the corresponding mating contact 420. Alternatively, the terminals 516*f* are power terminals. In another alternative embodiment, the terminals 516*e* are power terminals and the terminals 516*f* are ground terminals.

In the exemplary embodiment of FIGS. 17 and 18, the ground terminals 516*e* each include an opening 520 that receives an electrically conductive tab 522 (FIGS. 19 and 20) of a commoning member 524 (FIGS. 19 and 20), as will be described in more detail below. The dielectric body 502 includes a plurality of openings 526 that each exposes the opening 520 of a corresponding one of the ground terminals 516*e*. The openings 520 and 526 may have any suitable shape that enables the openings 520 and/or 526 to function as described and/or illustrated herein. The dielectric body 502 also includes a plurality of slots 546 that each receive a portion of a corresponding ground contact 523 (FIGS. 19 and 20) of the commoning member 524. The slots 546 may have any suitable shape that enables the slots 546 to function as described herein.

Figure 19:
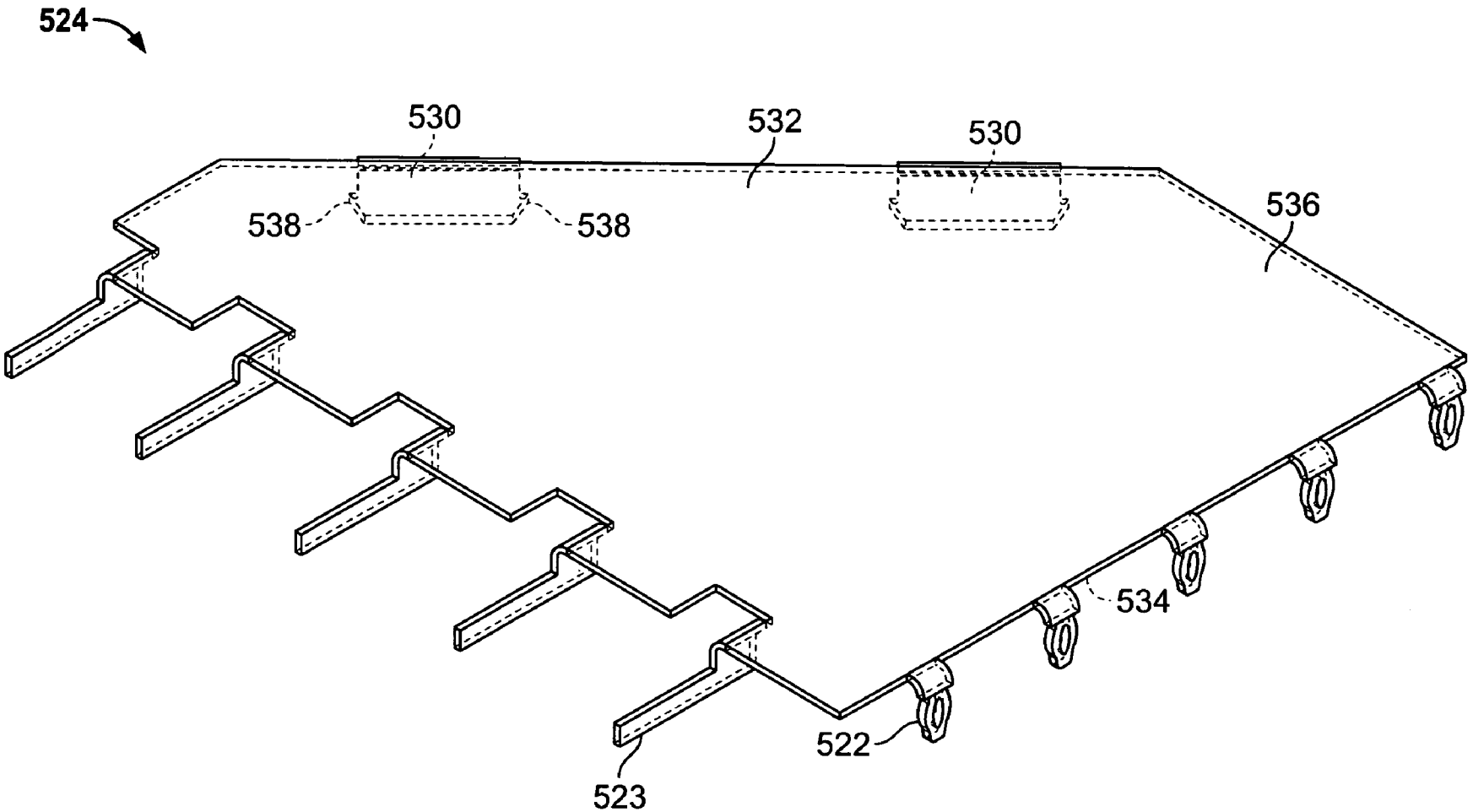
FIG. 19 is a perspective view of an exemplary embodiment of a commoning member that may be used with the contact module shown in FIG. 17.
Figure 20:
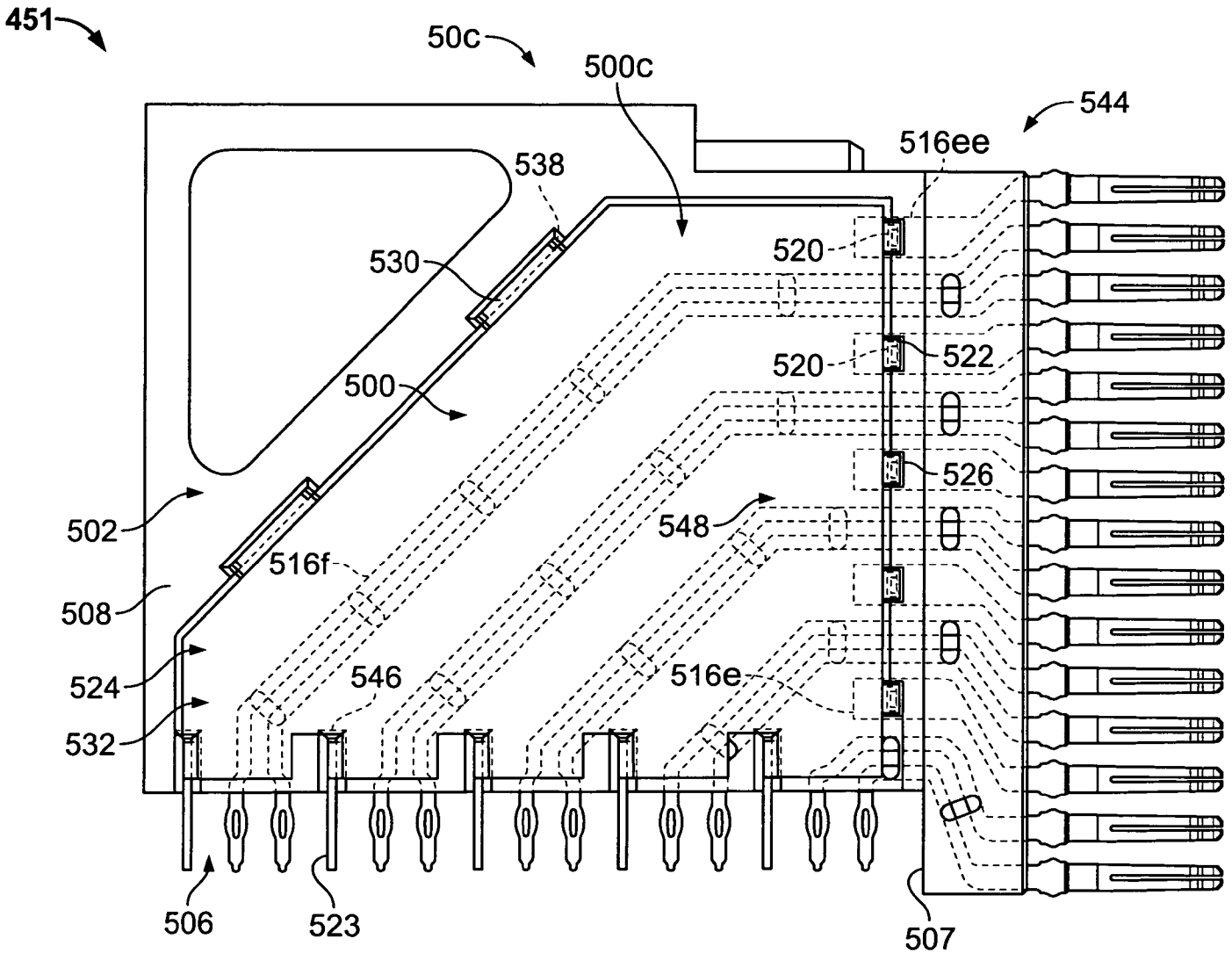
FIG. 20 is a perspective view of the commoning member shown in FIG. 19 mounted on the contact module shown in FIG. 17.

FIG. 19 illustrates an exemplary embodiment of the commoning member 524. The commoning member 524 includes a body 532 having opposite side portions 534 and 536. A pair of retention members 530 extend outwardly on the side portion 534 for reception within a corresponding opening 528 (FIG. 17) within the dielectric body 502 (FIG. 17) to facilitate holding the commoning member 524 on the contact module 451 (FIG. 17). The retention members 530 each include a pair of opposite hooks 538 that are configured to engage the dielectric body 502 adjacent the corresponding opening 528 to facilitate holding the commoning member 524 on the contact module 451. The commoning member body 532 also includes a plurality of the electrically conductive tabs 522 and a plurality of the ground contacts 523 extending outwardly on the side portion 534. In the exemplary embodiment of FIG. 17, the ground contacts 523 are each pin contacts. However, the ground contacts 523 may each be any suitable type of electrical contact, and may each have any suitable structure and/or means, that enable the ground contacts 523 to function as described and/or illustrated herein, such as, but not limited to, IDC, pin, and/or eye of the needle contacts.

The commoning member 524 may have any number of the tabs 522 and any number of the ground contacts 523, and the tabs 522 and ground contacts 523 may have any suitable relative arrangement and/or pattern on the commoning member body 532. FIG. 18 illustrates the commoning member 524 mounted on the dielectric body 502 of the contact module 451 to provide a contact module assembly 50C. Specifically, the commoning member 524 is mounted on the side portion 508 of the dielectric body 502. Each of the retention members 530 is received within the corresponding opening 528 within the dielectric body 502 such that the hooks 538 are engaged with the dielectric body 502 to facilitate holding the commoning member body 532 on the dielectric body 502 of the contact module 451.

Each of the tabs 522 is received within a corresponding opening 526 of the dielectric body 502. Each of the tabs 522 is also received within the opening 520 of a corresponding ground terminal 516*e* such that the tab 522 is directly physically engaged and electrically connected to the corresponding ground terminal 516*e*. Because the commoning member body 532 is fabricated at least partially from an electrically conductive material, the commoning member 524 forms a common ground of each of the ground terminals 516*e* that are electrically connected thereto.

In the exemplary embodiment, the pattern 544 of the contact module assembly 50C includes a plurality of differential pairs of signal terminals 516*f* that are separated from each adjacent pair by a single ground terminal 516*e*. The pattern 544 begins at the outermost terminal 516 (with respect to the intersection of the mounting edge portion 506 with the rearward facing end wall 507 of the contact module 451) with a ground terminals 516*e* and thereafter alternates differential pairs of signal terminals 516*f* with ground terminals 516*e* as the pattern 544 of signal and ground terminals 516*f* and 516*e*, respectively, moves toward the intersection of the mounting edge portion 506 with the end wall 507. The ground contacts 523 are each received within a corresponding slot 546 to form ground contacts on the mounting face 56 (FIG. 1) of the connector 10 (FIG. 1).

The patterns of signal, ground, and/or power terminals described and/or illustrated herein (e.g., the patterns 144, 344, and 544 shown in FIGS. 11, 14, and 20, respectively, as well as the patterns formed by the commoning members 424 and 624 that are shown in FIGS. 15 and 16) are meant as exemplary only. The lead frame embodiments described and/or illustrated herein may be programmable into any other suitable patterns of signal, ground, and/or power terminals that enables the lead frame to function as described herein.

The embodiments described herein provide an electrical connector having a programmable lead frame. The embodiments described herein provide an electrical connector that may cost less and/or be more easily manufactured as compared to at least some known electrical connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. A contact module assembly for an electrical connector, said contact module assembly comprising:

a lead frame having a plurality of terminals; and a commoning member at least partially comprising an electrically conductive material, the commoning member having a plurality of tabs that are electrically connected to selected ones of the terminals, thereby electrically commoning the selected ones of the terminals, at least one of the tabs of the commoning member comprising one of an insulation displacement contact (IDC), a pin contact, and an eye of the needle contact, and wherein the commoning member can be configured with different patterns of the tabs to selectively configure the lead frame with different patterns of commoned terminals.

2. The contact module assembly of claim 1, wherein at least one of the selected ones of the terminals is electrically connected to more than one of the tabs.

3. The contact module assembly of claim 1, wherein all of the terminals of the lead frame are electrically commoned by the commoning member.

4. The contact module assembly of claim 1, wherein the tabs physically secure the commoning member to the lead frame.

5. The contact module assembly of claim 1, wherein the commoning member includes a shield plate that extends coplanar with the lead frame.

6. The contact module assembly of claim 1, wherein the lead frame is held by a dielectric body, the tabs of the commoning member engaging the selected ones of the terminals through corresponding openings within the dielectric body.

7. The contact module assembly of claim 1, wherein each of the terminals includes a first electrical contact on a mating edge portion of the lead frame and a second electrical contact on a mounting edge portion of the lead frame, wherein at least one of the selected ones of the terminals does not include an intermediate portion that connects the first electrical contact with the second electrical contact.

8. The contact module assembly of claim 1, wherein the tabs of the commoning member engage necked-down portions of the selected ones of the terminals.

9. The contact module assembly of claim 1, wherein the tabs of the commoning member are received within openings within the selected ones of the terminals.

10. A contact module assembly for an electrical connector, said contact assembly comprising:

a lead frame having a plurality of terminals; and a commoning member at least partially comprising an electrically conductive material, the commoning member having a plurality of tabs that are electrically connected to selected ones of the terminals, thereby electrically commoning the selected ones of the terminals, wherein the commoning member can be configured with different patterns of the tabs to selectively configure the lead frame with different patterns of commoned terminals, and wherein each of the terminals extends between a mating edge portion and a mounting edge portion of the lead frame.

11. A contact module assembly for an electrical connector, said contact assembly comprising:

a lead frame having a plurality of terminals; and a commoning member at least partially comprising an electrically conductive material, the commoning member having a plurality of tabs that are electrically connected to selected ones of the terminals, thereby electrically commoning the selected ones of the terminals, wherein the commoning member can be configured with different patterns of the tabs to selectively configure the lead frame with different patterns of commoned terminals, wherein each of the terminals includes a first electrical contact on a mating edge portion of the lead frame and a second electrical contact on a mounting edge portion of the lead frame, and wherein at least one of the selected ones of the terminals does not include an intermediate portion that connects the first electrical contact with the second electrical contact.

12. An electrical connector comprising:

a housing;

first and second contact module assemblies held by the housing, each of the contact module assemblies comprising a lead frame having a plurality of terminals;

the first contact module assembly comprising a first commoning member at least partially comprising an electrically conductive material, the first commoning member having a plurality of first tabs that are electrically connected to selected ones of the terminals of the first contact module assembly, thereby electrically commoning the selected ones of the terminals of the first contact module assembly, the first tabs being arranged to configure the lead frame of the first contact module assembly with a first pattern of commoned terminals; and the second contact module assembly comprising a second commoning member at least partially comprising an electrically conductive material, the second commoning member having a plurality of second tabs that are electrically connected to selected ones of the terminals of the second contact module assembly, thereby electrically commoning the selected ones of the terminals of the second contact module assembly, the second tabs being arranged to configure the lead frame of the second contact module assembly with a second pattern of commoned terminals that is different from the first pattern.

13. The electrical connector of claim 12, wherein at least one of the terminals of the lead frame of the first contact module assembly is electrically connected to more than one of the first tabs.

14. The electrical connector of claim 12, wherein all of the terminals of the lead frame of the first contact module assembly are electrically commoned by the first commoning member.

15. The electrical connector of claim 12, wherein the first tabs physically secure the first commoning member to the lead frame of the first contact module assembly.

16. The electrical connector of claim 12, wherein the first commoning member includes a shield plate that extends coplanar with the lead frame of the first contact module assembly.

17. The electrical connector of claim 12, wherein the lead frame of the first contact module assembly is held by a dielectric body, the first tabs of the first commoning member engaging the selected ones of the terminals through corresponding openings within the dielectric body.

18. The electrical connector of claim 12, wherein each of the first and second tabs comprises one of an insulation displacement contact (IDC), a pin contact, and an eye of the needle contact.

19. The electrical connector of claim 12, wherein the first tabs of the first commoning member either engage necked-down portions of the selected ones of the terminals of the lead frame of the first contact module assembly or are received within openings within the selected ones of the terminals of the lead frame of the first contact module assembly.

20. The electrical connector of claim 12, wherein each of the terminals of the lead frame of the first contact module assembly extends between a mating edge portion and a mounting edge portion of the lead frame of the first contact module assembly, at least one of the terminals of the lead frame of the first contact module assembly including an intermediate portion that electrically connects a corresponding first electrical contact of the terminal on the mating edge portion with a corresponding second electrical contact of the terminal on the mounting edge portion.

* * * * *